US005186436A

United States Patent [19]

Cummings, Jr.

[11] Patent Number: 5,186,436

[45] Date of Patent: Feb. 16, 1993

[54] ELECTRIC FENCE POLE INSTALLATION APPARATUS

[76] Inventor: Beauregard Cummings, Jr., 315 Prairie Ct., Fayetteville, N.C. 28303

[21] Appl. No.: 876,317

[22] Filed: Apr. 30, 1992

[51] Int. Cl.[5] ..... E21B 19/00

[52] U.S. Cl. ..... 254/29 R

[58] Field of Search ..... 254/29 R, 30, 10.5; 29/227, 151

[56] References Cited

U.S. PATENT DOCUMENTS

| | | | |
|---|---|---|---|
| 3,096,075 | 7/1963 | Brown | 254/29 R |
| 3,115,726 | 12/1963 | Sayles . | |
| 3,329,401 | 7/1967 | Becker et al. | 254/29 R |
| 3,727,357 | 4/1975 | Stillman, Jr. . | |
| 3,871,617 | 3/1975 | Majima | 254/29 R |
| 4,147,457 | 4/1979 | Washida | 254/29 R |
| 4,402,166 | 9/1983 | Wortham, Jr. . | |
| 4,429,849 | 2/1984 | Maier . | |

*Primary Examiner*—Robert C. Watson

*Attorney, Agent, or Firm*—Henderson & Sturm

[57] ABSTRACT

An apparatus (10) for the single handed installation of an electrical fence pole (100) having a threaded end (103) and a stabilizing collar (104); wherein, the apparatus (10) has: a platform member (20) including a lower shelf element (21) adapted to receive the collar (104) and shaft (101) of the fence pole (100); an upper shelf element (22) adapted to transmit a downwardly directed force to the lower shelf element (21); and spring biased means (30) associated with the lower shelf element (21) for applying a downwardly directed force on the collar (104) to maintain the shaft (101) of the fence pole (100) in a vertical orientation, as the fence pole (100) is forced into penetrating engagement with the ground.

8 Claims, 3 Drawing Sheets 200
105
53
102
100
101
50
52
13
10
51
54
20
2
12
22
54
41
104
30
41
31
11
40
24
103
23
21
2

ELECTRIC FENCE POLE INSTALLATION APPARATUS

TECHNICAL FIELD

The present invention relates to the field of fence pole installation tools in general, and in particular to an installation tool that allows a single individual to install electrical fence poles.

BACKGROUND ART

This invention was the subject matter of Document Disclosure Program Registration No. 281,962 which was filed in the United States Patent and Trademark Office on May 17, 1991.

As can be seen by reference to the following U.S. Pat Nos. 3,727,357; 4,402,166; 4,429,849; and 3,115,726; the prior art is replete with myriad and diverse stabilized fence pole constructions.

While all of the aforementioned prior art constructions are more than adequate for the basic purpose and function for which they have been specifically designed, these patented devices are of little value at all to a person who is faced with the chore of installing a string of electrical fence posts, particularly when that individual must accomplish that task by themselves.

As a consequence of the foregoing situation, there has existed a longstanding need among farmers and ranchers having little or not extra help when it becomes necessary to install electrical fencing around a selected piece of land for a self contained apparatus that will position and temporarily restrain a fence pole at a selected location to allow the user to install the fencepost unaided; and, the provision of such a construction is a stated objective of the present invention.

DISCLOSURE OF THE INVENTION

Briefly stated, the fence pole installation apparatus that forms the basis of the present invention comprises in general: a platform unit; a spring based plate unit operatively associated with the platform unit; and, a handle/stabilizer unit also operatively associated with the platform unit.

As will be explained in greater detail further on in the specification, both the platform unit and the plate unit are provided with differently contoured slots which cooperate with the shaft and anchor collar of a electrical metal fence pole, to maintain the fence pole in an upright position, so that the user can install the fence pole in a "hands-off" manner. By virtue of this arrangement a single worker can install a string of fence poles in a quick, efficient manner without any outside assistance.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
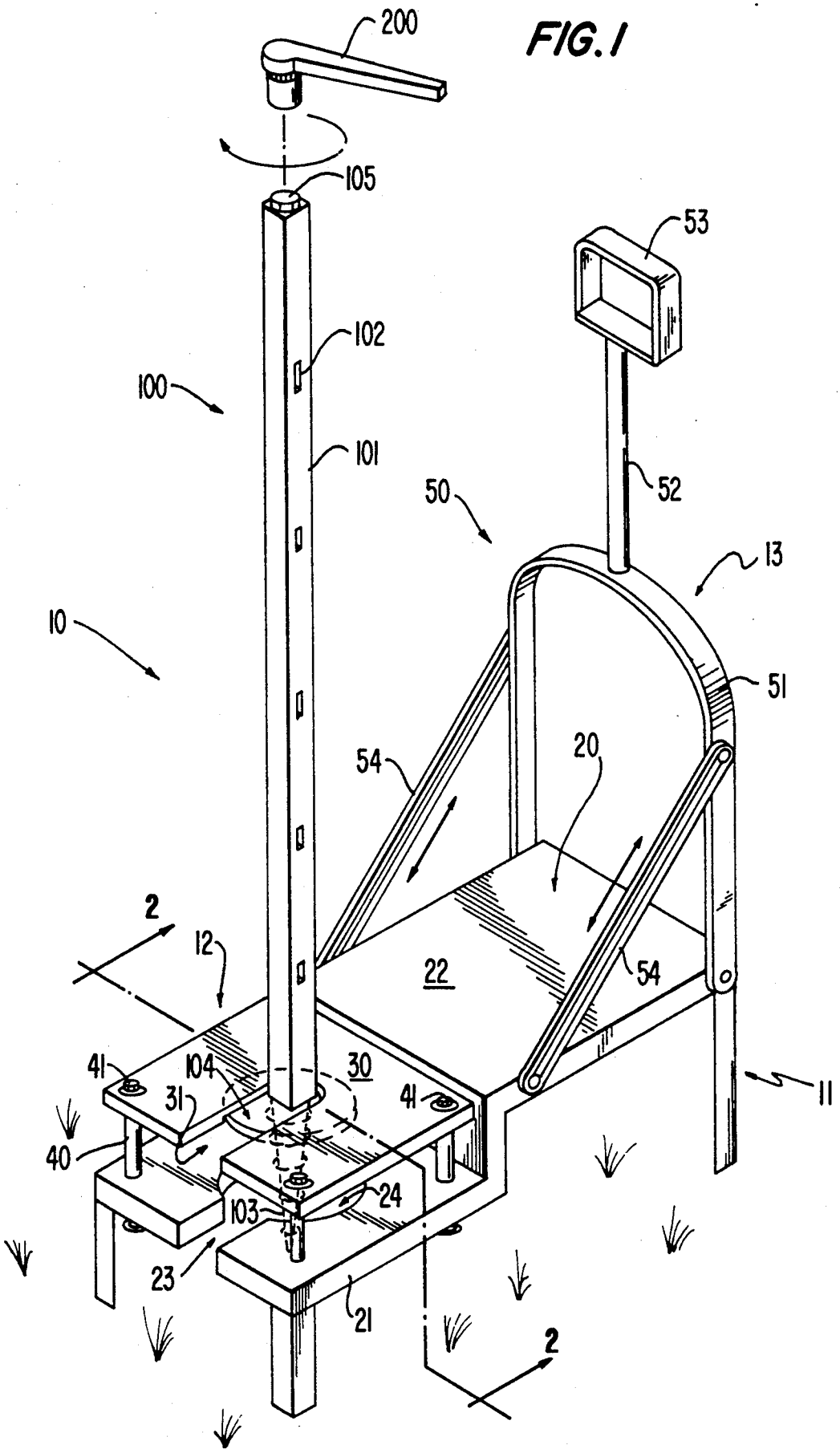
FIG. 1 is a perspective view of the apparatus in use.

As can be seen by reference to the drawings, and in particular to FIG. 1, the electrical fence pole installation apparatus that forms the basis of the present invention is designated generally by the reference numeral (10). The apparatus (10) comprises in general: a platform unit (11); a spring biased plate unit (12); and, a combination handle/stabilizer unit (13). These units will now be described in seriatim fashion.

Figure 2:
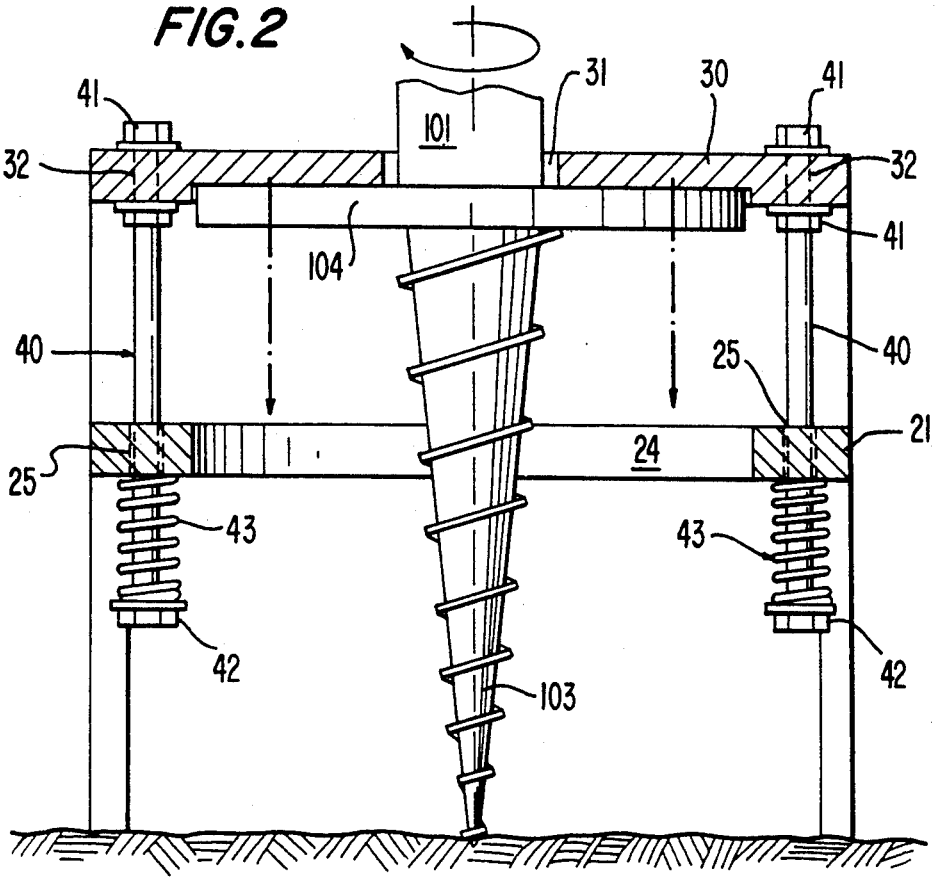
FIG. 2 is a cross-sectional view of the initial engagement between the fence pole and the apparatus as viewed through line 2—2 of FIG. 1.
Figure 3:
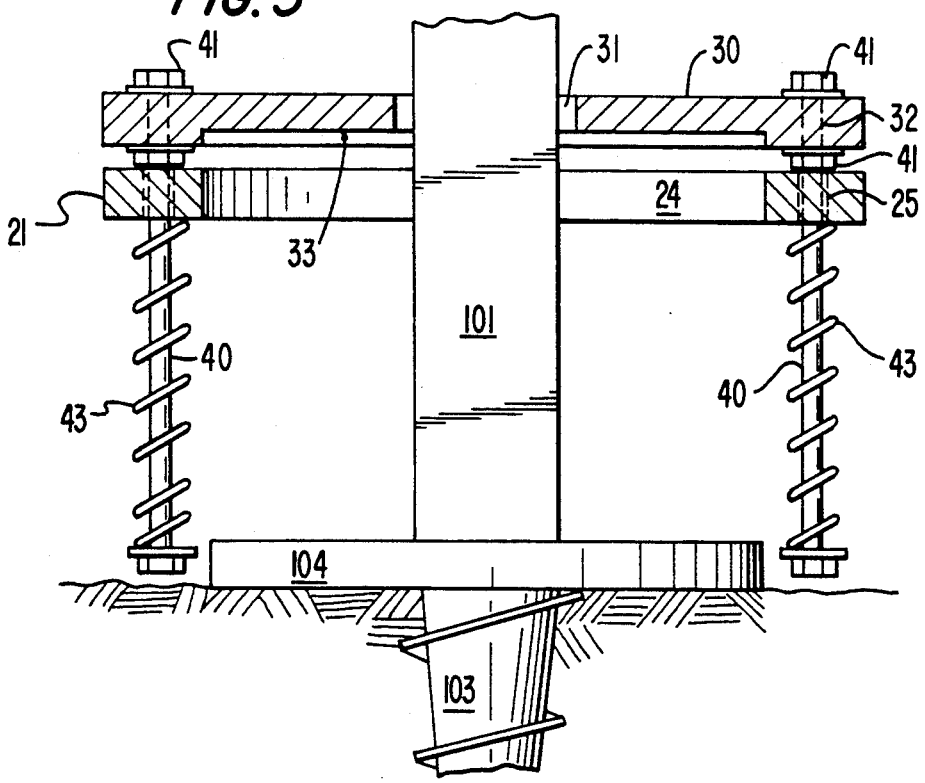
FIG. 3 is a cross-sectional view of the final engagement between the fence pole and the apparatus as viewed through line 2—2 of FIG. 1.

As shown in FIGS. 1 through 3, the platform unit (11) comprises a stepped shoulder platform member (20) having a lower generally rectangular platform shelf (21) operatively connected to an upper generally rectangular platform shelf (22); and, a plurality of support legs (23) connected to both said upper (21) and lower (22) platform shelves to raise both of said platform shelves (21)(22) to selected respective heights above the ground. In addition the lower platform shelf (21) projects a substantial distance outwardly from the upper platform shelf (22), for reasons that will be explained in greater detail further on in the specification.

As can best be seen by reference to FIG. 1, it can be seen that the leading edge of the lower shelf element (21) is provided with a contoured slot (23) which intersects an enlarged central aperture (24); and, is further provided with a plurality of discrete apertures (25) which are arrayed in a spaced relationship relative to the enlarged central aperture (24).

Still referring to FIGS. 1 through 3, it can be seen that the spring biased plate unit (12) comprises a generally rectangular plate member (30) dimensioned to overlie the outwardly projecting portion of the lower shelf element (21); wherein, the leading edge of the plate member (30) is further provided with an elongated slot (31); and, wherein a plurality of apertures (32) are disposed proximate the corners of the plate member (30).

In addition, the bottom surface of the plate member (30) is provided with an enlarged generally circular recess (33), which is disposed in a surrounding relationship relative to the terminus of the elongated slot (31).

Turning now specifically to FIGS. 2 and 3, it can be seen that the operative connection between the lower shelf element (21) and the spring biased plate member (30) comprises a plurality of elongated threaded bolts (40) dimensioned to be slideably received within the aligned apertures (32) and (25) in the plate member (30) and lower shelf element (21) respectively.

Furthermore, the threaded upper portion of the bolts (40) are provided with a pair of oppositely threaded nut members (41) which captively engage the plate member (30); and, the threaded lower portion of the bolts (40) are provided with another threaded nut member (42) which captively engages an elongated helical spring member (43) intermediate the threaded nut (42) and the bottom of the lower shelf elements (21).

As shown in FIG. 3, the spring member (43) normally biases the plate member (30) into engagement with the lower shelf element (21) in the absence of any independent intervening structure, such as an electrical fence pole (100).

Returning once more to FIG. 1, it can be seen that the combined handle/stabilizer unit (13) comprises a handle member (50) pivotally secured on one end to the upper shelf element (22) and including: a generally U-shaped handle framework element (51) whose lower portion is operatively connected to the upper shelf element (21); a handle shaft (52) projecting upwardly from the handle framework element (51); and a hand grip element (53) disposed on top of the handle shaft (52).

In addition, the handle framework element (51) is further provided with a pair of apertured brace elements (54), which limit the pivoting motion of the handle member (50) to a generally perpendicular orientation relative to the upper shelf element (21).

Prior to embarking on a detailed description of the apparatus (10) of this invention it should first be appreciated that the apparatus (10) was developed for use in conjunction with an electrical fence pole (100) having the following physical elements: an elongated metal shaft (101) having vertically spaced discrete apertures (102); a tapered screw point (103) formed on one end; an enlarged generally flat stabilizing collar (104) disposed in a surrounding relationship to the shaft (101); and, a multi-sided gripping head (105) formed on top of the shaft (101).

In the preferred mode of operation depicted in FIGS. 1 through 3, the shaft (101) of the fence pole (100) is inserted through the slots (31) and (23) of the plate member (30) and the lower shelf element (21) such that the top of the stabilizing collar (104) is received in the recess (33) formed in the bottom of the plate member (30).

At this juncture, the user positions the point (103) of the fence pole shaft (101) at the desired location of installation of the fence pole (100), and proceeds to grasp the hand grip element (53) of the handle (50) while placing one foot on top of the upper shelf element (22). This downwardly directed force on the platform member (20) will dispose the fence pole shaft (101) collar (104) and point (103) in the orientation depicted in FIGS. 1 and 2.

Then the user will employ a rotational force to the shaft (101) by engaging the gripping head (105) with an elongated tool (200) to screw the point (103) of the shaft (101) into penetrating engagement with the soil, until the collar (104) comes into firm engagement with the soil as shown in FIG. 3.

Figure 4:
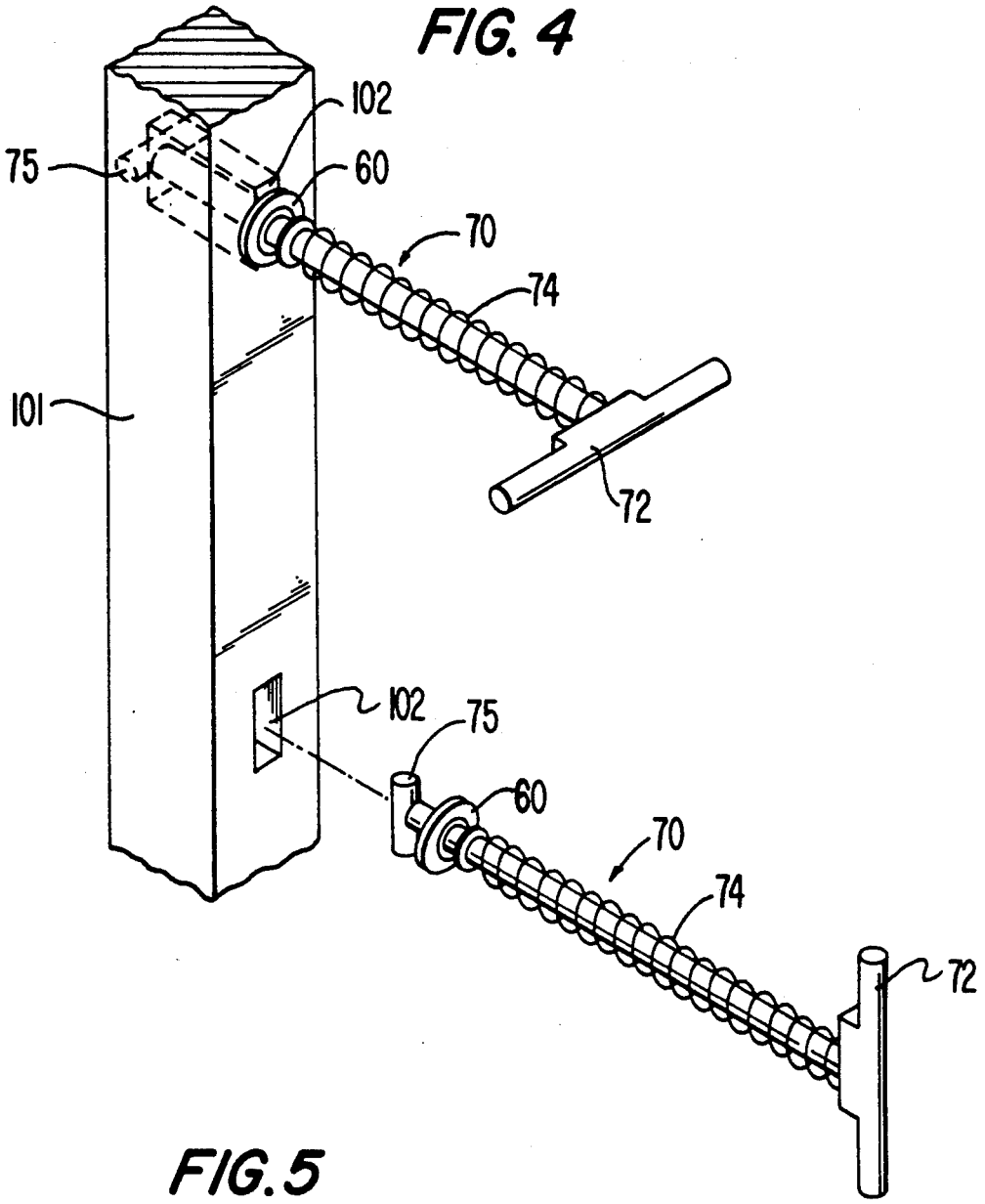
FIG. 4 is an exploded perspective view of the cooperation between the wireholder pin, wireholder and fence pole; and, FIG. 5 is an enlarged detail view of the cooperation between the wireholder and the wireholder pin.
Figure 5:
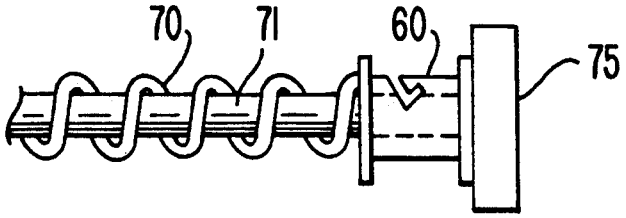

Turning now to FIGS. 4 and 5, it can be seen that once the fence pole (10) is installed at the desired location a wire holder element (60) is forced onto a spring loaded wire holder pin (70); wherein, the inboard end of the wire holder pin (70) inserted into a selected aperture (102) in the fence pole shaft (101).

Once the key head (75) of the wire holder pen (70) is received in the aperture (102) the shaft (71) is rotated by the handle (72) to captively engage the key head (75) within the fence pole shaft (101); while the wire holder element (60) is forced against the exterior of the fence pole shaft (101) by the action of the spring (74).

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. An apparatus for installing an elongated metal fence pole having a metal shaft provided with: a tapered point on one end; an enlarged collar formed proximate said one end; and further having a multi-sided gripping head formed on the other end; wherein, the apparatus comprises:

a stepped shoulder platform member having an upper platform element; a lower platform element which projects outwardly from said upper platform element; wherein, said lower platform element is provided with an enlarged aperture dimensioned to receive both said shaft and said enlarged collar of the fence pole; and, spring biased means operatively associated with the lower platform element for providing a downwardly directed force against the top of said enlarged collar to maintain said fence pole in a vertical orientation relative to said apparatus as the fence pole is forced into the ground.

2. The apparatus as in claim 1; wherein, said spring biased means comprises:

a plate member dimensioned to overlie said lower platform element and further provided with an elongated slot dimensioned to slideably receive only the shaft of said fence pole.

3. The apparatus as in claim 2; wherein, both the lower platform element and the plate member are provided with a plurality of discrete aligned apertures dimensioned to slideably receive a plurality of elongated threaded bolts; wherein, each bolt is provided with a plurality of threaded nut elements.

4. The apparatus as in claim 3; further comprising a plurality of elongated helical springs operatively associated with said plurality of threaded nut elements and bolts and having one end engaged with the lower platform element for normally biasing the plate member into engagement with the lower platform element.

5. The apparatus as in claim 2; wherein, the bottom of the plate member is provided with an enlarged recess dimensioned to receive said collar and disposed in an overlapping relationship with said elongated slot.

6. The apparatus as in claim 5; wherein, the lower platform element is provided with a slot which intersects said enlarged aperture and which is further dimensioned to slideably receive only the shaft of said fence pole.

7. The apparatus as in claim 1; further comprising a handle member pivotally connected to said platform member.

8. The apparatus as in claim 7; wherein, said handle member is provided with means for limiting the pivotal movement of said handle member relative to the top of said upper shelf member to an angular orientation of approximately 90°.

* * * * *